US005822713A

United States Patent [19]

Profeta

[11] Patent Number: 5,822,713

[45] Date of Patent: Oct. 13, 1998

[54] GUIDED FIRE CONTROL SYSTEM

[75] Inventor: Joseph A. Profeta, Gibsonia, Pa.

[73] Assignee: Contraves USA, Pittsburgh, Pa.

[21] Appl. No.: 42,719

[22] Filed: Apr. 5, 1993

[51] Int. Cl.[6] ..... F41G 3/16; F41G 3/08

[52] U.S. Cl. ..... 701/302; 364/559; 342/67

[58] Field of Search ..... 364/516, 514, 364/423, 561, 559, 460, 462; 701/300, 302; 342/67

[56] References Cited

U.S. PATENT DOCUMENTS

| | | | |
|---|---|---|---|
| 3,339,457 | 9/1967 | Pun . | |
| 3,659,494 | 5/1972 | Philbrick et al. | 89/28.05 |
| 3,845,276 | 10/1974 | Kendy et al. | 235/404 |
| 4,370,914 | 2/1983 | Voles | 89/41.05 |
| 4,531,052 | 7/1985 | Moore | 364/561 |
| 4,622,458 | 11/1986 | Boeck et al. | 364/516 |
| 4,787,291 | 11/1988 | Frohock, Jr. | 89/41.22 |
| 4,878,752 | 11/1989 | Bramley | 356/152 |
| 4,922,801 | 5/1990 | Jaquard et al. | 89/41.05 |

OTHER PUBLICATIONS

"On Deck. On Guard. On Target. LSEOS MK II, Electro–Optical Fire Control System", 1992.

*Primary Examiner*—Michael Zanelli

*Assistant Examiner*—Ed Pipala

*Attorney, Agent, or Firm*—Ansel M. Schwartz

[57] ABSTRACT

The present invention is a fire control system. The fire control system comprises a manually aimed gun having a sighting device and a device for acquiring a target. The acquiring device is disposed at a location remote from the gun. The fire control system also comprises a device for determining the trajectory of the target with respect to the gun and providing information relating to the target to the sighting device of the gun such that an operator of the gun can aim the gun with respect to the sighting device to hit the target when the gun is fired. The determining device is in communication with the acquiring device and the sighting device. The present invention is also a fire control method for a minor caliber gun. The method comprises the step of acquiring a target from a location which is remote from the gun. Then, there is the step of determining the trajectory of the target with respect to the gun. Next, there is the step of providing information relating to the target to a sighting device of the gun. Then, there is the step of manually aiming the gun in accordance with the information appearing on the sighting device such that the gun is aimed to accurately hit the target when fired.

34 Claims, 15 Drawing Sheets

GUIDED FIRE CONTROL SYSTEM

FIELD OF THE INVENTION

The present invention is related in general to fire control systems. More specifically, the present invention is related to a fire control system for a manually aimed minor caliber gun.

BACKGROUND OF THE INVENTION

Historically, minor caliber (<40 mm) weapon stations have been crew-operated with the crew providing both manual weapon movement and aiming. Sights generally were little more than iron reticles with gunnery limited by visual conditions. Such small caliber weapon stations offered no night capability and had limitations imposed by inclement weather such as smoke and fog, frequent conditions found in operational situations. In addition, manual tracking of targets with no ballistic computer makes the best description of manually aimed small caliber guns limited to "best guess" solutions.

Recent advancements in day/night sights, laser ranging, stabilization, target acquisition and tracking and digital processing have led to a new generation of highly accurate weapon stations. These new weapon stations are capable of accurate target engagements twenty-four hours a day, even while being subjected to disturbances such as vibration and movement. While these performance improvements have been impressive, there has been a price to pay. That price has been an evolution toward remotely operated weapon stations with a significant increase in weight and complexity (cost). A typical control sequence for a remotely operated motorized weapon is shown in FIG. 5. In remotely operated weapon systems, target acquisition data, such as infrared imaging, laser ranging and stabilization are used to directly control a mechanical positioning device to automatically aim the gun. Because of the complexity and cost of modern fire control systems, they have not been used with minor caliber manually aimed guns. Since modern warfare is now dependent on twenty-four hour capability while providing superior fire control accuracy, it is necessary to develop a manually aimed gun having access to the sophisticated fire control technology of many remotely operated weapon stations.

The present invention utilizes modern fire control technology and provides a full director fire control solution (both day AND night) for manually aimed weapon stations. A director gun mount configuration allows a gunner to position the gun to the correct target ballistic elevation and azimuth offset positions to ensure a high probability of target hit.

SUMMARY OF THE INVENTION

The present invention is a fire control system. The fire control system comprises a manually aimed gun having a sighting device. The system also comprises means for acquiring a target. The acquiring means is disposed at a location remote from the gun. The fire control system also comprises means for determining the trajectory of the target with respect to the gun and providing information relating to the target to the sighting device of the gun such that an operator of the gun can aim the gun with respect to the sighting means to hit the target when the gun is fired. The determining means is in communication with the acquiring means and the sighting means.

Preferably, the acquiring means comprises a radar device and an electro-optical tracker device having a FLIR imaging device and a laser rangefinder. The acquiring means can also comprise a day TV camera device.

The determining means can also include a stabilization device for maintaining the aim of the gun, means for determining the position and movement of a vehicle, such as a ship, upon which the fire control system is disposed and means for determining the environmental conditions about the gun. The trajectory determining means can also include a gun operator data entry device and means for tracking the target.

In a preferred embodiment, the trajectory determining means provides a reticle to the sighting device. The trajectory determining means displaces the reticle such that when the reticle is manually aimed on the target, the gun is aimed to accurately hit the target when fired. The trajectory determining means can also provide direction of motion symbology on the sighting device based on the direction and magnitude required to correctly aim the gun and range data. Preferably, the sighting device of the gun includes a video display monitor.

Preferably, the acquiring means comprises a control console having a control video monitor. Preferably, the trajectory determining means comprises means for providing a FLIR image of the target to the video display monitor of the gun. Preferably, the gun comprises a fire enable gate which enables the gun for firing only when the gun is correctly aimed to hit the target. The fire enable gate is in communication with the trajectory determining device. The fire control system can also comprise a device for providing training images to the video display monitor of the gun such that the fire control system can operate in a training mode.

The present invention is also a fire control method for a minor caliber gun. The method comprises the step of acquiring a target from a location which is remote from the gun. Then, there is the step of determining the trajectory of the target with respect to the gun. Next, there is the step of providing information relating to the target to a sighting device of the gun. Then, there is the step of manually aiming the gun in accordance with the information appearing on the sighting device such that the gun is aimed to accurately hit the target when fired.

Preferably, after the acquiring step, there is the step of tracking the target. Preferably, the providing step includes the step of providing a displaced reticle on a video display monitor of the sighting device. Preferably, the providing step includes the step of providing a FLIR image of the target on the video display monitor.

BRIEF DESCRIPTION OF THE DRAWINGS

In the accompanying drawings, the preferred embodiment of the invention and preferred methods of practicing the invention are illustrated in which.

DESCRIPTION OF THE PREFERRED EMBODIMENT

Figure 1:
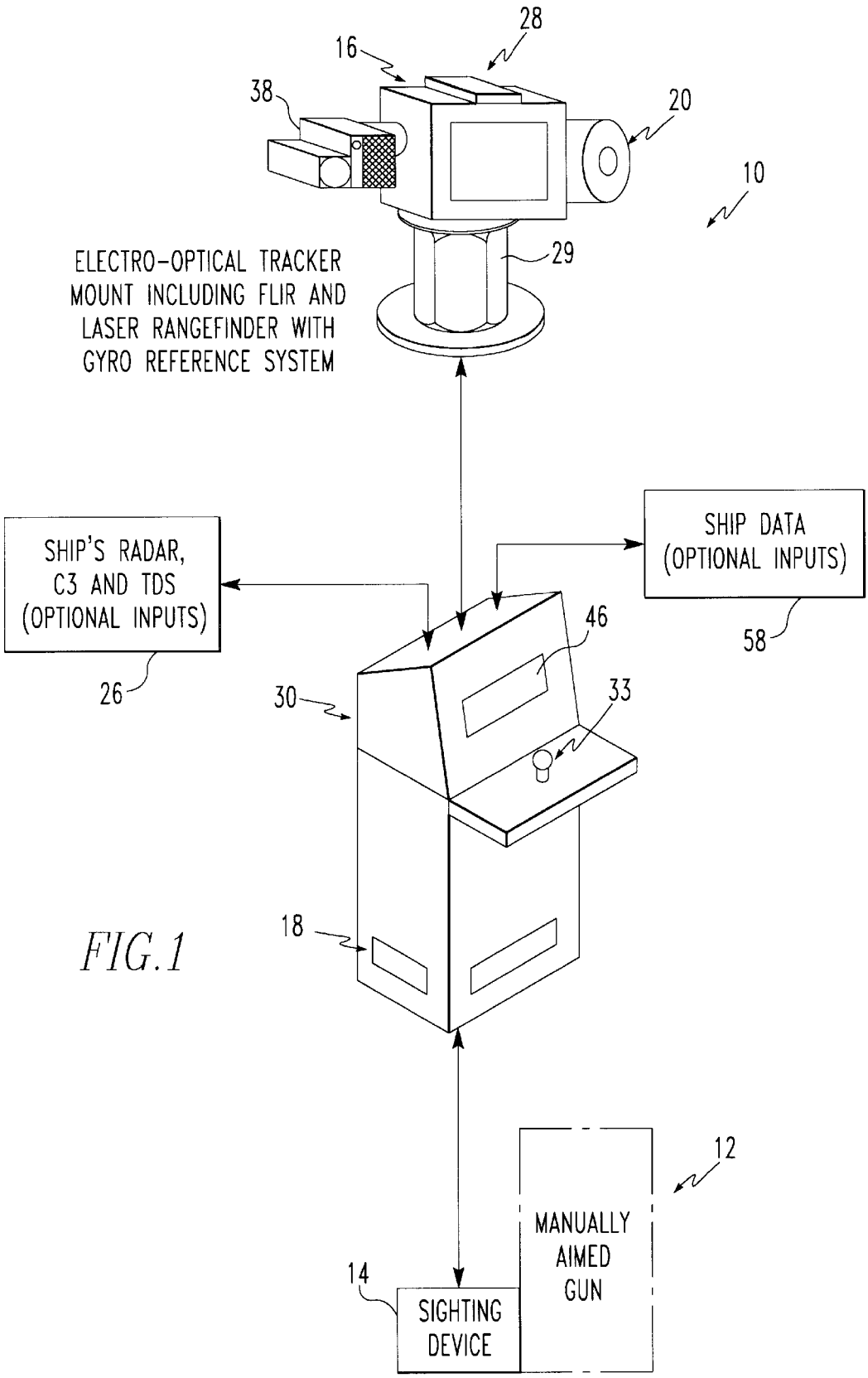
FIG. 1 is a schematic representation of the fire control system.

Referring now to the drawings wherein like reference numerals refer to similar or identical parts throughout the several views, and more specifically to FIG. 1 thereof, there is shown a fire control system 10. The fire control system 10 comprises a manually aimed gun 12 having a sighting device 14. The fire control system 10 also comprises means 16 for acquiring a target. The acquiring means 16 is preferably disposed at a location remote from the gun 12. The fire control system 10 also comprises means 18 for determining the trajectory of the target with respect to the gun 12 and providing information relating to the target to the sighting device 14 of the gun 12 such that an operator of the gun 12 can aim the gun 12 with respect to the sighting device 14 to hit the target when the gun 12 is fired. The determining means 18 is in communication with the acquiring means 16 and the sighting device 14.

Figure 2:
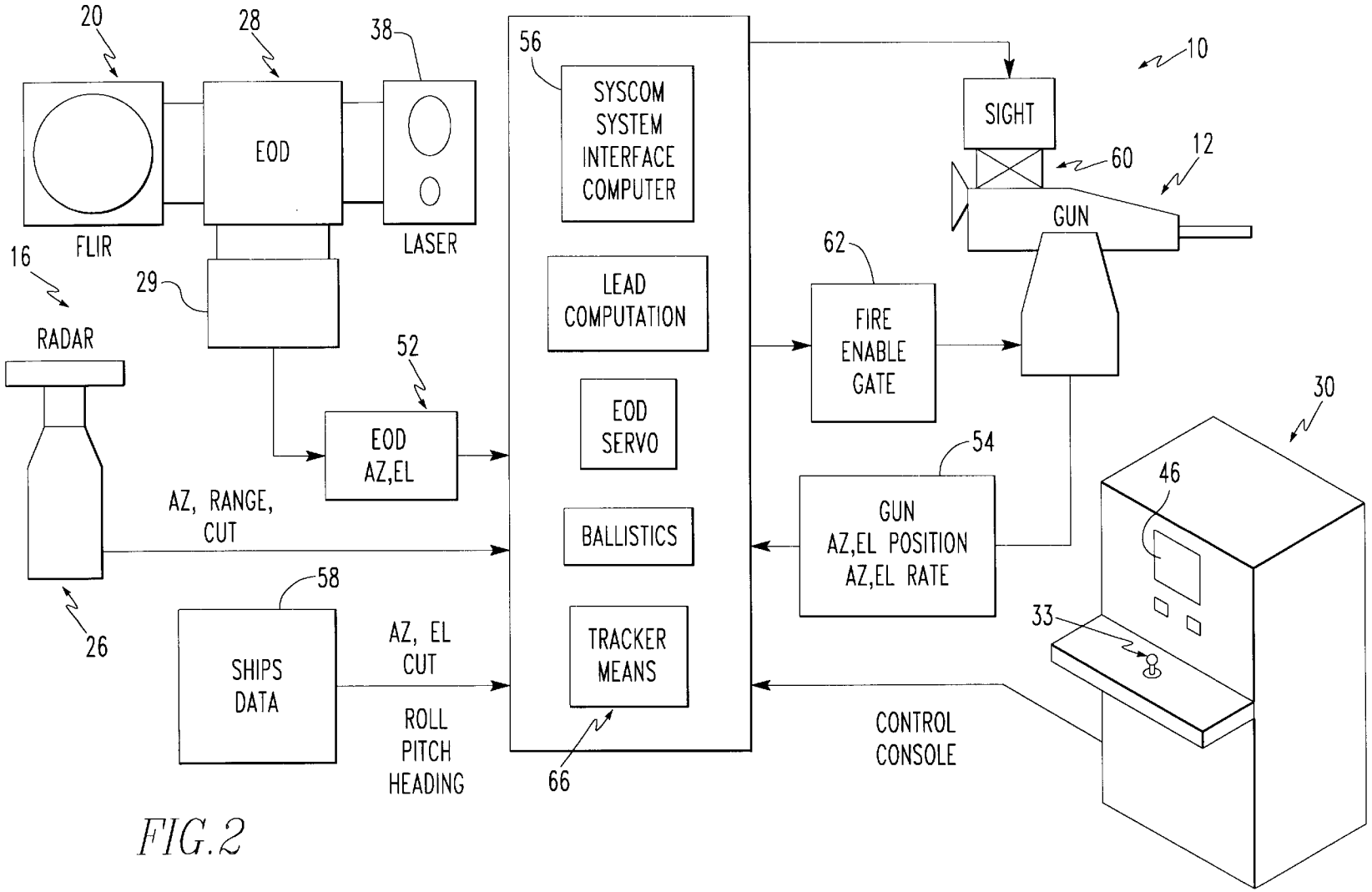
FIG. 2 is a schematic representation of the fire control system.

Preferably, the target trajectory determining means 18 comprises means 66 for tracking the target, as shown in FIG. 2. This allows the operator of the gun 12 to manually aim the gun 12 using information which was gathered at a location remote from the gun 12 and displayed on the gun's sighting device 14. In this manner, a minor caliber gun (less than 50 mm), such as a BMARC 20 mm gun, can have access to, for instance, the advanced target acquisition, imaging and tracking systems which are disposed on board many modern naval vessels and which were previously used only for the automatic control of large caliber guns and missile systems such as the Contraves LSEOS Mark II Lightweight Shipboard Electro-Optic System. Preferably, the determining means 18 performs a dynamic offset computation on the target's track so that the gun 12 can be properly aimed to hit the target when the gun 12 is fired. Dynamic offset compensation is an analytical computation based on ballistics, platform dynamics, environmental conditions, target dynamics and geometrical relationship between the acquiring means 16 and the gun 12.

In one embodiment of the invention, the acquiring means 16 comprises an infrared imaging device, or FLIR device 20 which locates a target based on the heat it produces. The FLIR device 20 produces a signal corresponding to the position of the target and provides the signal to the determining means 18. The determining means 18 provides infrared images based on the signal from the FLIR device 20 to the sighting device 14 of the gun 12 such that an operator of the gun 12 can manually aim the gun 12 in poor vision conditions, such as at night or in fog or through smoke and hit the target when the gun is fired. Furthermore, the FLIR device 20 provides the gunner with the ability to perform day and night surveillance operations.

As shown in FIGS. 4*c*–4*f*, the trajectory information of the target is provided to the sighting device 14 of the gun 12 with a reticle 32 which is displaced relative to the actually sighting line of the gun 12 such that when the reticle 32 is aimed on the target, the gun 12 is aimed to accurately hit the target when fired. The displaced reticle 32 compensates for lead, gravity drop and other aiming requirements.

In addition to a displaced reticle 32, the determining means 18 can also supply direction of motion symbology 36 to the sighting device 14 based on the direction and magnitude required to correctly aim the gun 12. The direction of motion symbology 36 can be used by the gunner to move the gun 12 towards the position of the target acquired by the acquiring means. The determining means 18 can also provide range data 42 to the sighting device 14. Preferably, the sighting device 14 comprises a video display monitor 34.

The target acquisition means 16 preferably comprises a radar device 26 and an electro-optical device (EOD) 28 which is rotatably mounted on a pedestal 29 and which is controlled remotely, such as from a control console 30 having a joystick 33 and a control display screen 46, as shown in FIG. 2. The electro-optical device 28 is used to obtain more detailed acquisition information of the target identified by the radar device 26 or by a target designation site (TDS). Various embodiments of the target acquisition means 16 are shown in FIGS. 7*a*–7*d*. The electro-optical device 28 preferably has an FLIR imaging device 20 and a laser rangefinder device 38. Examples of commercially available FLIR imaging devices 20 are Kollsman's AN/TAS-4B, Pilkington's HPS 2000/N, Brunswicks' AN/KAS-1 or Texas Instruments TILSEOS. Examples of commercially available eyesafe laser rangefinders 38 are Laser Atlanta's A7000 or A10000, Varo's (IMO) ER ESLR, Litton's SL-4/10 or SL-4/ES, EOS of Australia's ESLR or Hughes MI laser. Preferably, the laser rangefinder 38 provides a pulse of laser light at least every two seconds. If a specific target engagement scenario is deemed an overriding concern, faster pulse rates for short engagement periods can be accommodated.

Figure 3A:
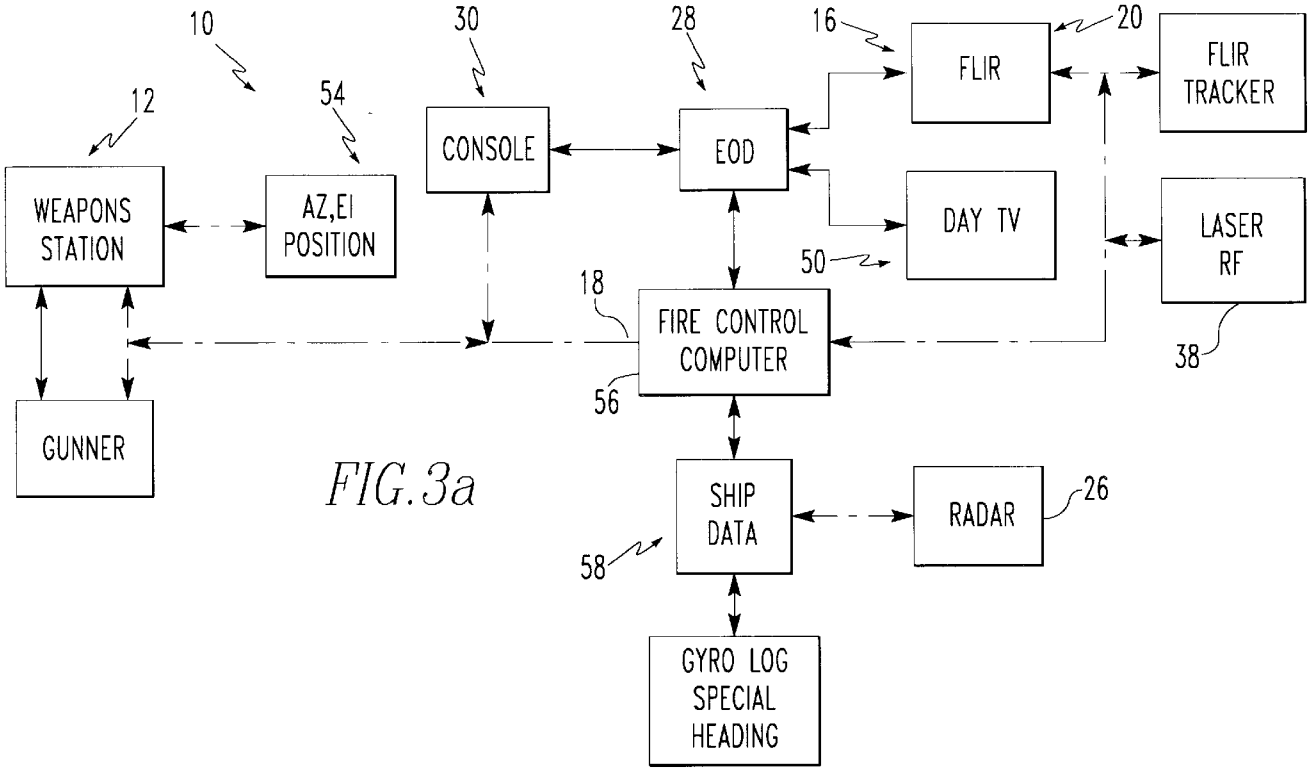
FIGS. 3*a* and 3*b* are block diagram representations of the fire control system.

As shown in FIG. 3*a*, the electro-optical device 28 can also comprise a conventional day TV 50 which operates at a different spectral energy band than the FLIR 20. The radar device 26, in typical situations, initially acquires the target by displaying a blip on a radar screen of the radar device 26. The radar can be an active or passive radar.

The following represents specifications for an FLIR device 20 having high resolution and sensitivity.

| | |
|---|---|
| System Magnification | 3×/12× |
| Wide FOV | 8 deg × 12 deg |
| Narrow FOV | 2 × 3 |
| IFOV Narrow FOV | 0.12 mrad |
| Detector Type | 8 BAR Sprite |
| Cooler Type | Joule Thompson |

In order to sense the position of the electro-optical device 28, the determining means 18 preferably also comprises means 52 for sensing the position and movement of the electro-optical device 28 with respect to a predetermined reference system, as shown in FIG. 2. For instance, the sensing means 52 can comprise a conventional T-shaft transducer mounted on the pedestal 29 which provides signals representing the azimuth and elevation of the electro-optical device 28. In order to sense the position of the gun 12, the determining means 18 also comprises means 54 for sensing the position and movement of the gun 12 with respect to a predetermined reference system. The gun sensing means 54 preferably provides signals representing the guns azimuth and elevation and rate of change to the determining means 18. The gun sensing means 54 can be a conventional encoder or transducer for such purposes.

Figure 9:
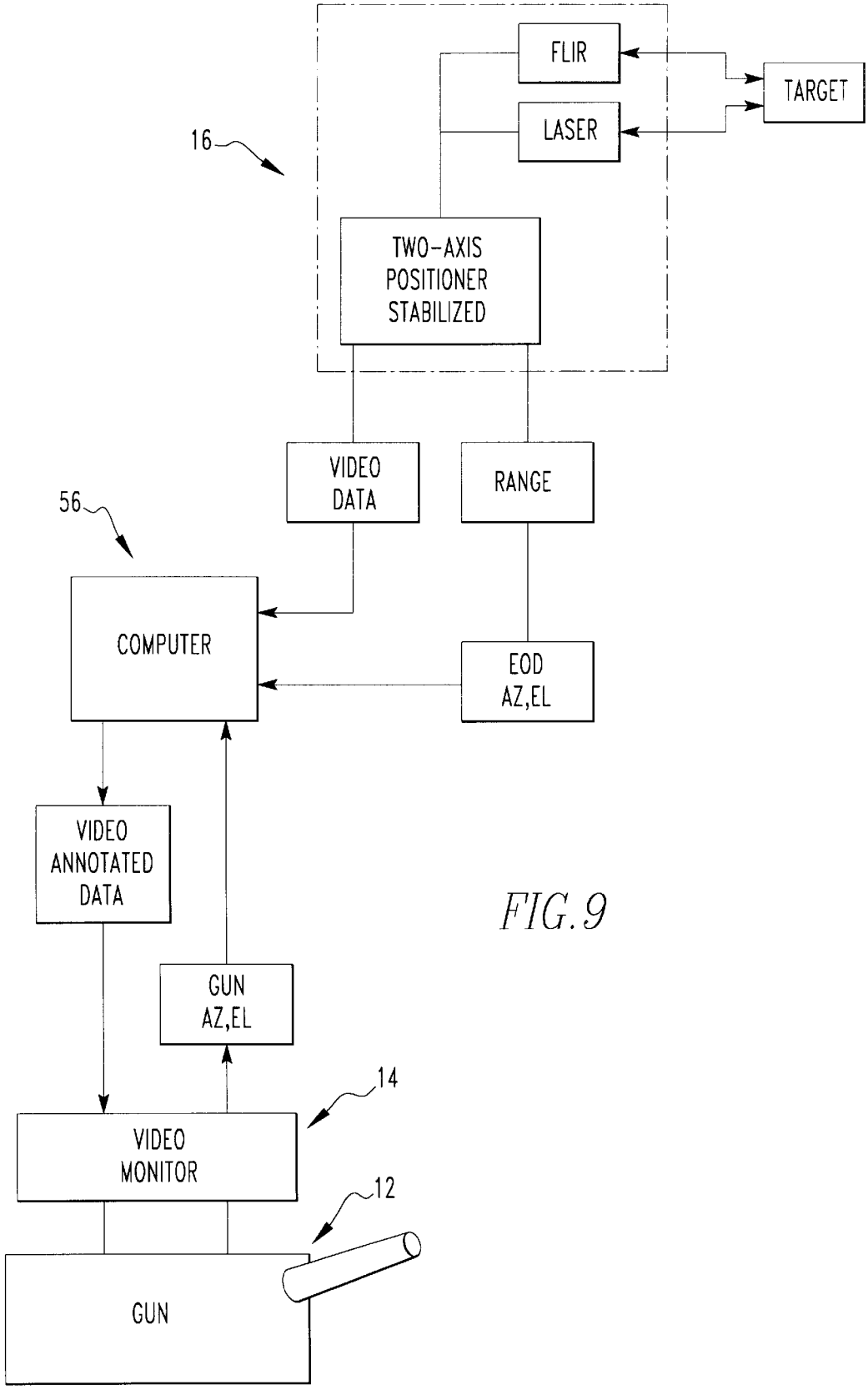
FIG. 9 is a block diagram of one embodiment of the fire control system.

Preferably, the determining means 18 comprises a computer 56. The computer 56 utilizes azimuth and elevation data from the position sensing means 52, 54 of the electro-optical device 28 and gun 12, respectively, and target range data from the laser RF 38 to determine a full director fire control solution. Preferably, the computer 36 is a SYSCOM computer 56. The flow of information with respect to the computer 56 is shown in FIG. 9.

In order to obtain increased ballistic accuracy, the determining means 18 can also comprise a stabilization device, such as a Honeywell or Litton Gyro System, for allowing the operator of the gun 12 to aim the gun during conditions of instability. The determining means can also comprise means for sensing the environmental conditions about the gun 12, such as atmospheric temperature and barometric pressure, wind speed and wind direction with the necessary conventional sensors for the same. Preferably, the determining means 18 comprises means 58 for supplying data from a vehicle, such as a ship, upon which the fire control system 10 is mounted. The data can include information such as the ships azimuth, elevation, cut, pitch, roll and heading which can be obtained by well known techniques.

The determining means 18 can also comprise a gun operator data entry device 60 to allow the gunner to input information which can be utilized by the determining means to accurately determine the trajectory of the target. For instance, the gunner can input muzzle velocity data or environmental override parameters.

The following represents typical fire control compensations:

| | |
|---|---|
| System Alignment | (encoder offsets, tilts) Must be included in all systems. |
| Parallax | −20 mr uncompensated |
| Needs survey data | .1 mr compensated |
| Needs target range | |
| Using a default range 2000M | −(+10 mr error) |
| Super E1 | (0 to 31 mr) |
| Needs target range | |
| Default Range 2000M | (−13 to +11 mr) |
| Ballistic Drift | (0 to .9 mr) |
| Needs target range | |
| Default Range 2000M | (±.45 mr) |
| Cross Wind | |
| 20 kt | (1.4 to 9.5 mr) |
| Atmospheric Pressure | (0 to 3.6 mr) |
| Ship Velocity | |
| 20 kt → 10 m/s→ | (12 to 64 mr) |
| Target Velocity | |
| 20 kt→ 10 m/s→ | (12 to 64 mr) |
| 200 kt→ 100 m/sec | (120 to 640 mr) |

If desired, the fire control system 10 can also include a fire enable gate 62 which is used to aid the gun operator in firing of the gun 12 only when the gun relative to the target movement rate, acceleration and azimuth and elevation rate show the correct target aim point is achieved. This ensures that the gun 14 will fire only when the conditions are proper while a trigger of the gun 14 is depressed to a first detent position. This improves the probability of the target being hit and allows accurate controlled firing in areas such as coastal and harbor areas, while minimizing risk to civilian and friendly forces. An emergency gunner override "Battle Short" can be used as a backup when the gun operator deems it necessary, by depressing the gun trigger to a second detent position.

If desired, the computer 56 can generate graphics of backgrounds and targets which can be displayed on the video display monitor 34 of the gun 12. This feature allows for gunner training and scoring which improves gunner proficiency and accuracy while reducing average firing times.

The present invention is also a fire control method for a minor caliber gun 12. The method comprises the steps of acquiring a target from a location which is remote from the gun 12. Then, there is the step of determining the trajectory of the target with respect to the gun 12. Next, there is the step of providing information relating to the target to a sighting device 14 of the gun 12. Next, there is the step of manually aiming the gun 12 in accordance with the information appearing on the sighting device 14 such that the gun 12 is aimed to accurately hit the target when fired.

Preferably, after the acquiring step, there is the step of tracking the target. Preferably, after the tracking step, there is the step of performing a dynamic offset computation on target track. Preferably, the providing step includes the step of providing a displaced reticle 32 on the video monitor 34 of the sighting device 14. Preferably, the providing step includes the step of providing an FLIR image of the target on the video display monitor 34 and after the providing step, there is the step of enabling the gun 12 when it is aimed in a direction to hit the target. Preferably, after the enabling step, there is the step of firing the gun 12. Preferably, the acquiring step includes the step of acquiring a target with radar.

Figure 3B:
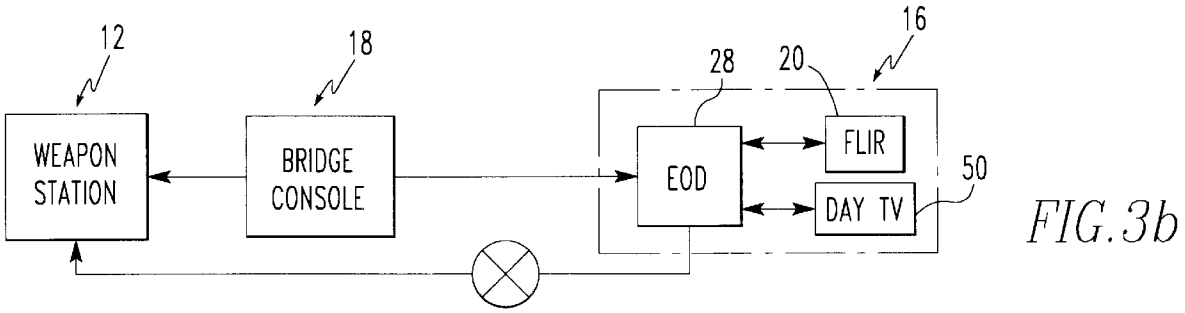

In an alternative embodiment, as shown in FIG. 3*b,* there is no determining means 18. The electro-optical device 28 provides information to the sighting device 14 without trajectory information. A gunner then aims and fires the gun based on what he sees in the monitor 34 such as an FLIR image of the target. In this case, the monitor may allow the gunner to see what he otherwise could not.

In the operation of one embodiment of the invention, the fire control system 10 is disposed on a ship such as a military vessel. The gun 12 is a 20 mm BMARC GAM gun and is mounted on the ship's deck. For purpose of description, it will be assumed that the ship is patrolling waters having enemy ships in poor visibility conditions, such as at night.

Figure 4A:
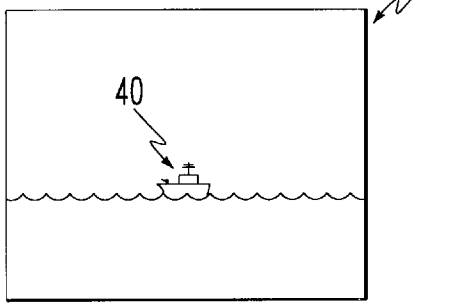
FIGS. 4*a*–4*f* are schematic representations showing the control video monitor and the video monitor of the gun.
Figure 4B:
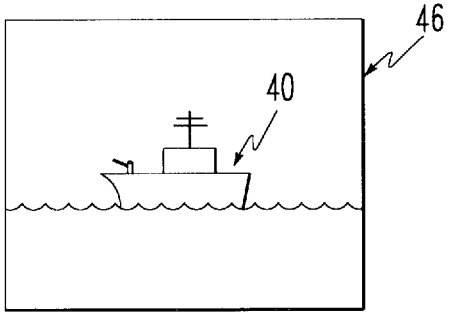
Figure 4C:
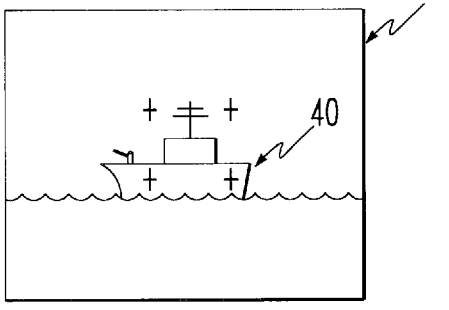
Figure 4D:
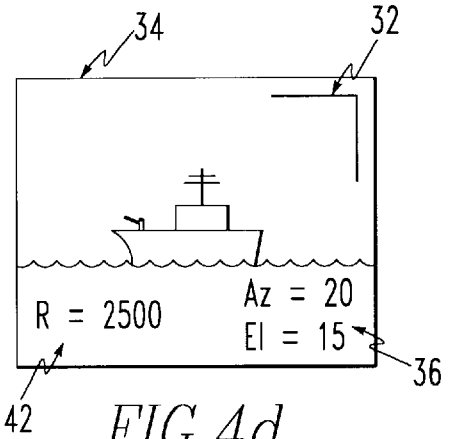

Initial acquisition of a target 40 is typically accomplished with the ship's radar system 26 and a target management system (TMS), as is well known in the art. In order to identify the target, the electro-optical device 28 is activated to locate the target 40 in a wide field of view which is shown on the control video monitor 46 of the control console 44, as shown in FIG. 4*a*. The control console 30 is located within the interior of the ship. Once the target 40 is located with the electro-optical device 28 in the wide field of view mode, the target 40 is more accurately identified by switching to a narrow field of view as shown in FIG. 4*b*. The FLIR device 20 provides an infrared image of the target 40 to the control video monitor 46 of the control console 30. An operator of the control console 30 controls movement of the electro-optical device 28 with joystick 34. Once the target 40 is acquired within a narrow field of view, the tracking device 66 can be engaged to automatically track the target 40. At this point, the video display monitor 34 of the gun 12 can also be provided with an infrared image of the target 40 so that the gunner can see the target 40. If the ballistic situation is relatively simple, the gunner can simply use the infrared image to see the target and mentally approximate a ballistic solution. If, on the other hand, the gunner seeks ballistic computation, the computer 56 can compute a ballistic solution depending on the sensed conditions of the fire control system 10.

Figure 4E:
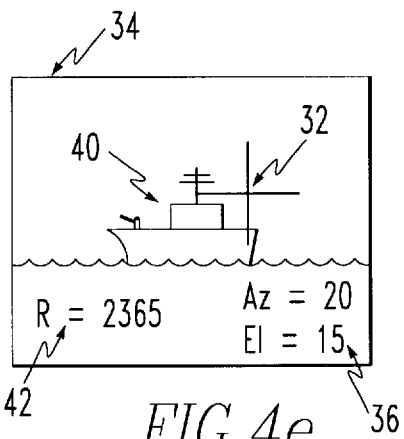
Figure 4F:
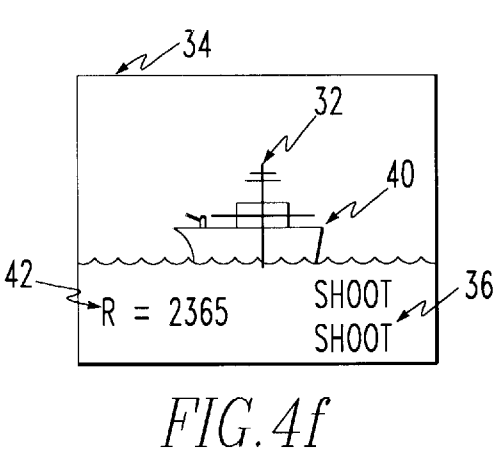
Figure 10:
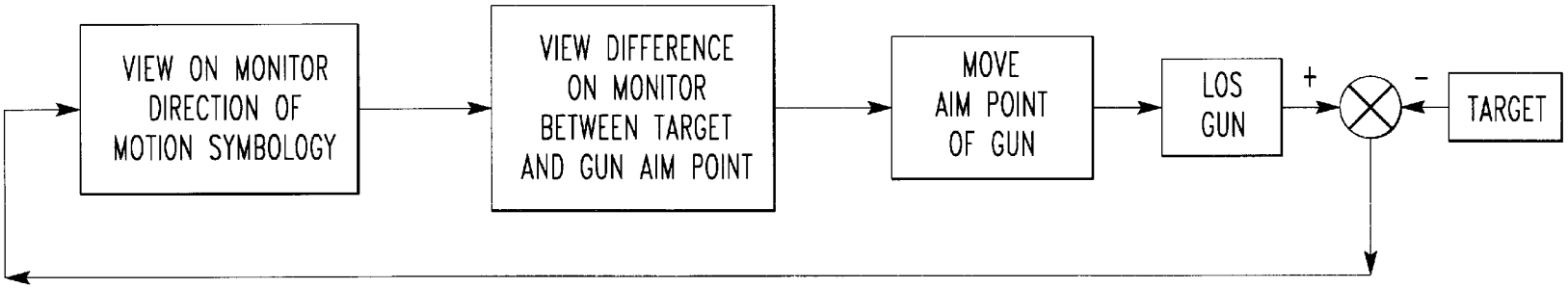
FIG. 10 is a flow chart representing steps related to the fire control system.

Once a fire control solution is computed by the computer 56, the information is provided to the video display monitor of the gun 12. The computer 56 provides a RS170 video signal to the video display monitor 34. The gunner then moves the gun 12 towards the target using the direction of motion symbology 36 which changes with respect to the gun's movement. As the gunner moves the gun 12, the computer 56 constantly updates the direction of motion symbology 36 and the position of the displaced reticle 32 by sensing the relative positions between the gun 12 and the target 40. This process is shown in FIG. 10. The reticle 32 converges on the target 40 nonlinearly, as shown in FIG. 4*e*. When the reticle 32 is accurately positioned on the target, the direction of motion symbology 36 spells "SHOOT" in the azimuth and elevation positions. At this point, the gun is aimed to properly engage with the target 40 and the fire enable gate 62 is enabled to allow firing of the gun 12 at the gunner discretion.

Figure 5:
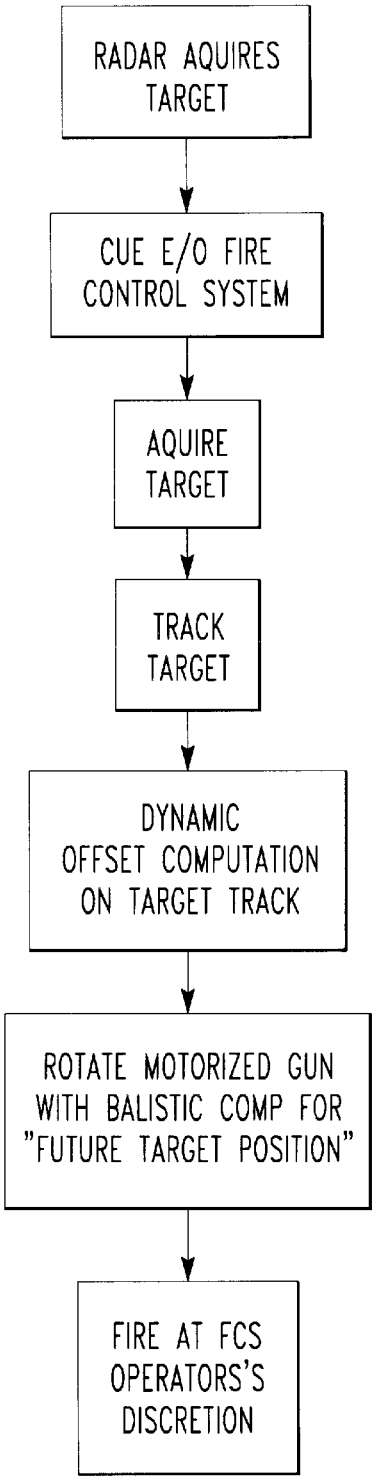
FIG.5 PRIOR ART
FIG. 5 is a flow chart of the steps related with a prior art fire control system.
Figure 6A:
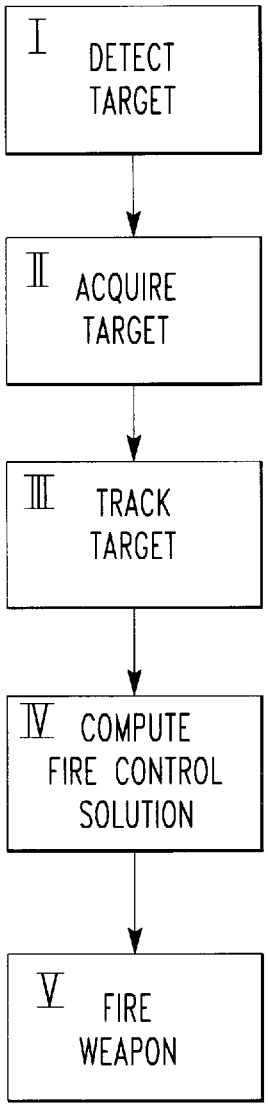
FIGS. 6*a*–6*f* are flow charts representing the steps related to the fire control system.
Figure 6B:
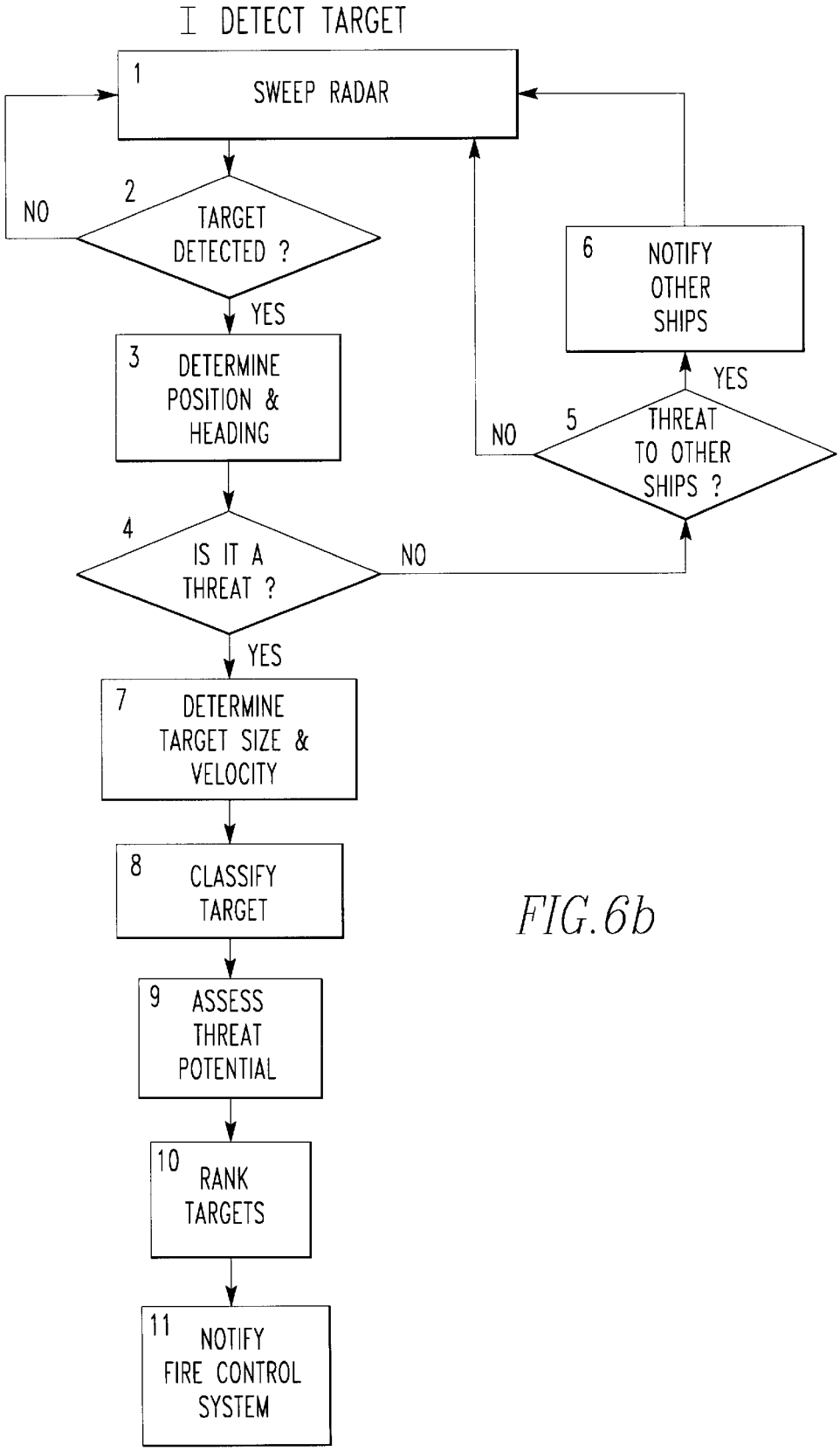
Figure 6C:
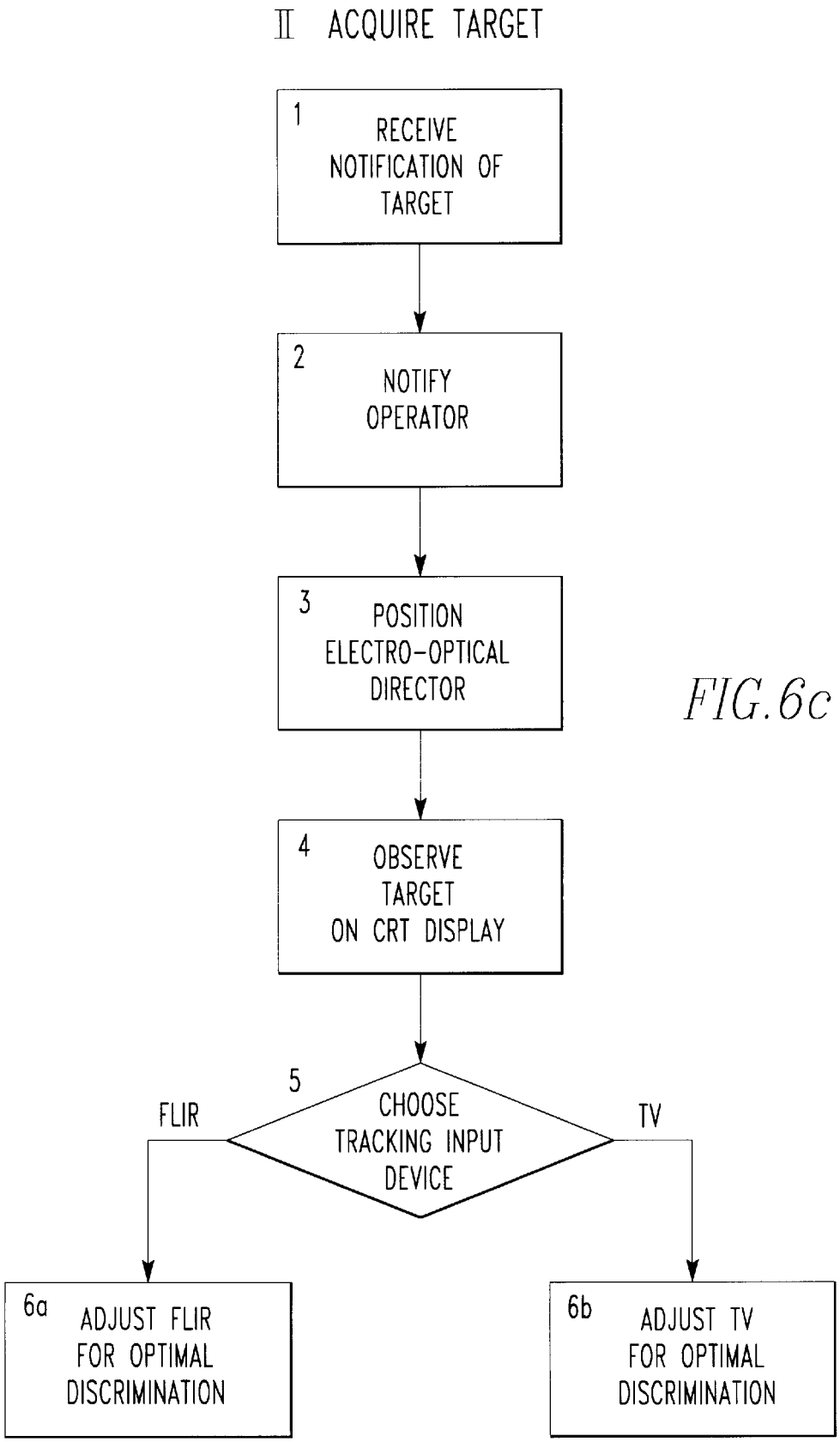
Figure 6D:
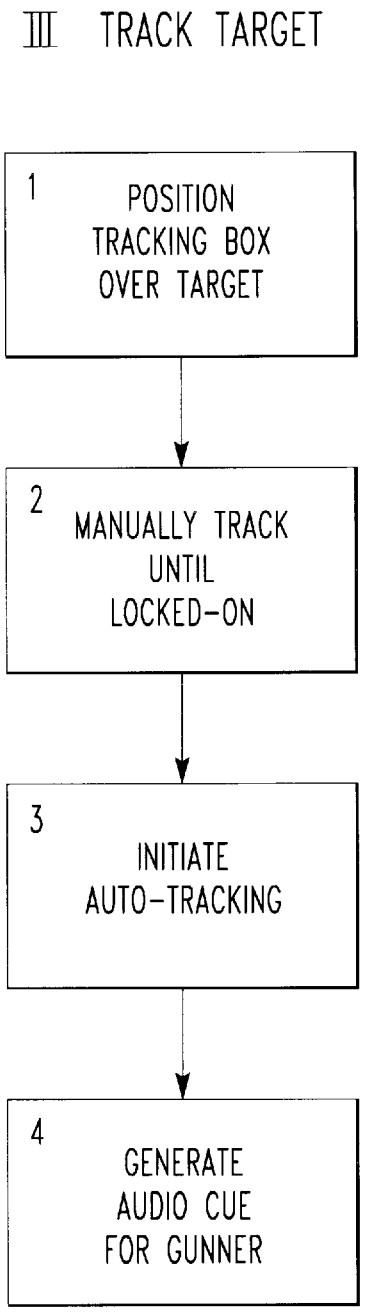
Figure 6E:
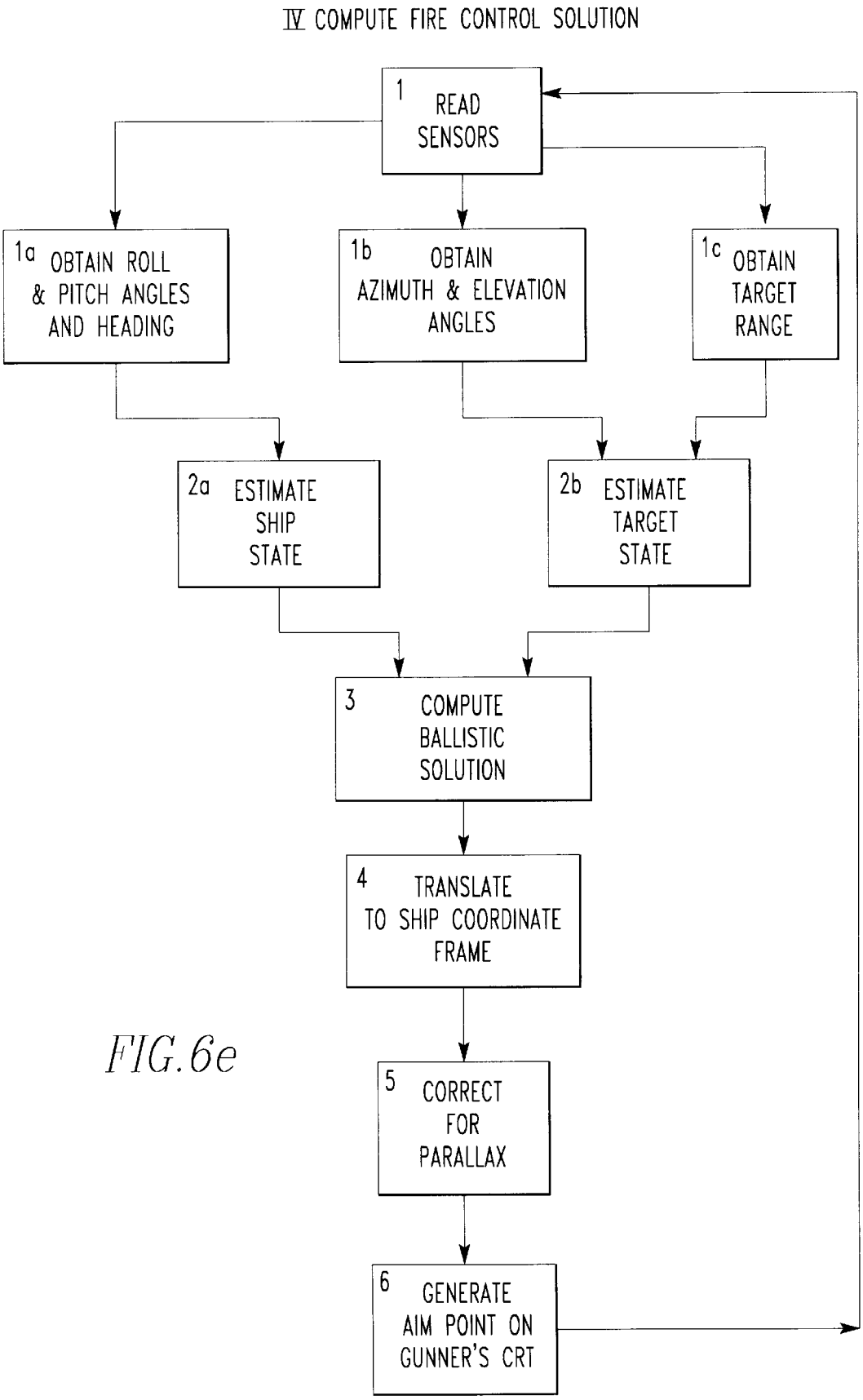
Figure 6F:
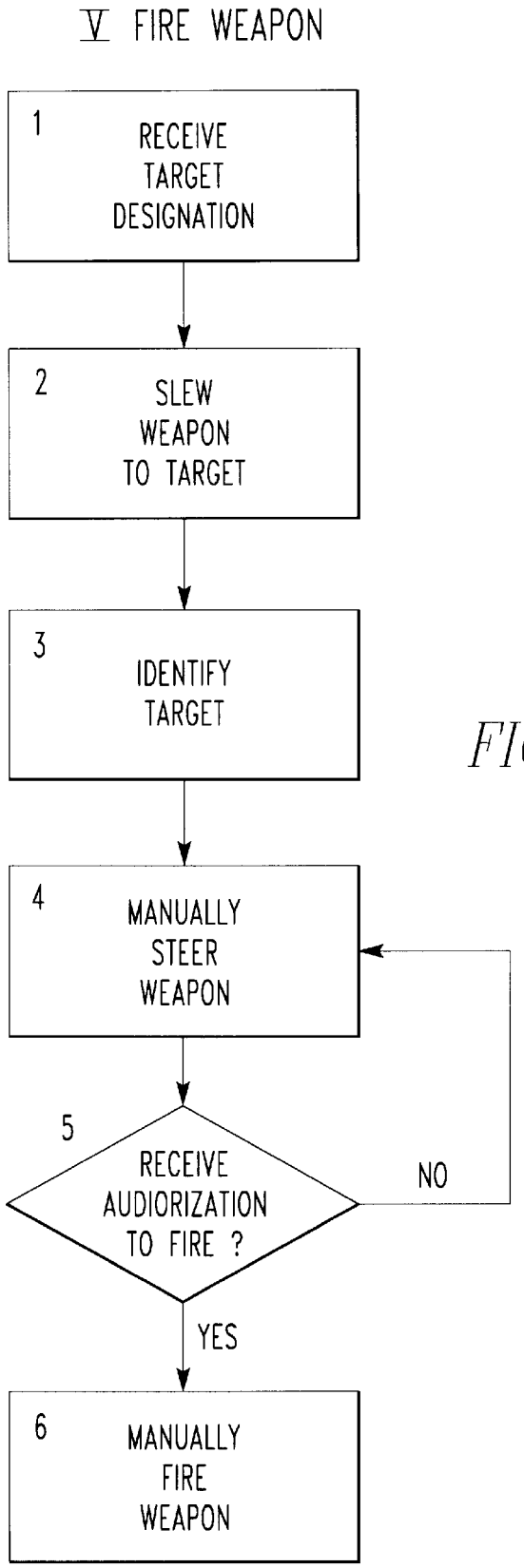
Figure 7A:
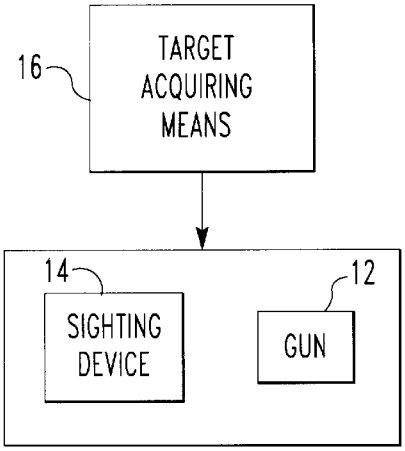
FIGS. 7*a*–7*d* are block diagrams showing various embodiments of the fire control system.
Figure 7B:
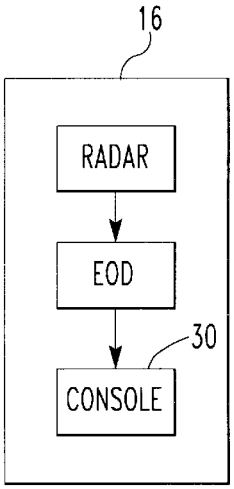
Figure 7C:
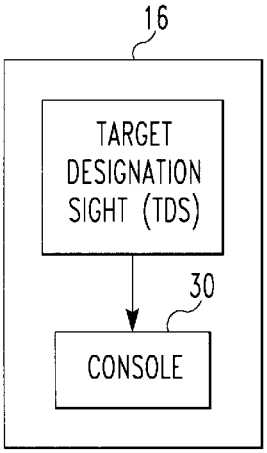
Figure 7D:
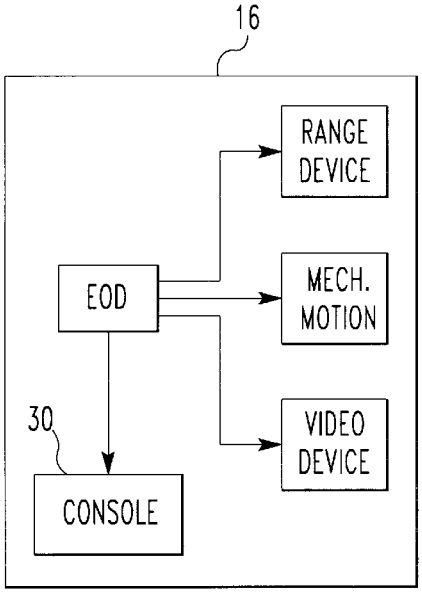

A summary of the fire control method of the present invention is shown in FIGS. 6*a*–6*f*. As a comparison, FIG. 5 shows a prior art fire control method. In the prior art, a ballistic computation is determined and is used to directly control the motion of the gun. This stands in contrast to the present invention which determines a ballistic solution and provides this information to the gunner in order for the gunner to manually aim the gun. In this manner, small caliber guns can take advantage of the advanced imaging techniques and ballistic computation information which were previously used only to control large caliber guns and missile systems.

The following represents a summary of the steps illustrated in FIGS. 6*a*–6*f*.

I. DETECT TARGET

I.1 Sweep Radar. Radar is sweeping continuously in order to locate targets.

I.2 Target Detected? The target is initially detected when a spot is observed on the PPI.

I.3 Determine Position & Heading. The target's position is observed directly from radar. Its heading is determined by measuring the change in position on successive radar sweeps.

I.4 Is It a Threat? At this point, determination of threat is based on the target's heading. If it is headed toward the ship, it is deemed a threat, otherwise, not.

I.5 Threat to Other Ships? The determination of threat to other ships in the fleet is, once again, based on the target's heading.

I.6 Notify Other Ships. The operator contacts other ships, deemed to be at risk, of the threatening target.

I.7 Determine Target Size & Velocity. Target size is determined by observing the size of the spots representing the targets. Target velocity is determined by measuring changes in target position on successive radar sweeps.

I.8 Classify Target. Targets are classified by size and velocity as either airplanes, missiles, helicopters or ships, according to the following table:

| | Airplane | Missile | Helicopter | Ship |
|---|---|---|---|---|
| Size | .7 PU | .1 PU | .5 PU | 1 PU |
| Velocity | .7 PU | 1 PU | .5 PU | .1 Pu |

I.9 Assess Threat Potential. Evaluate threat based on target classification, position and heading.

I.10 Rank Targets. When all targets have been evaluated in terms of threat potential, they are ranked in order of decreasing threat.

I.11 Notify Fire Control System. The fire control system is notified of the most threatening target in terms of target classification, position and velocity.

II. ACQUIRE TARGET

II.1 Receive Notification of Target. The fire control system is notified by the Target Management System of the classification, position and velocity of the most threatening target.

II.2 Notify Operator. The operator is notified by means of output devices on the Operator Control Console (OCC).

II.3 Position Electro-Optical Director. The azimuth and elevation axes of the EOD are rotated to point the FLIR and laser rangefinder toward the target.

II.4 Observe Target on CRT. The FLIR or TV image of the target is displayed on an OCC CRT display, allowing target recognition.

II.5 Choose Tracking Input Device. Operator chooses between FLIR tracking and TV tracking depending on environmental conditions and target characteristics.

II.6*a* Adjust FLIR For Optimal Discrimination. The operator adjusts FLIR controls, including level and field of view, to optimize target discrimination.

II.6*b* Adjust TV For Optimal Discrimination. The operator adjusts TV controls to optimize target discrimination.

III. TRACK TARGET

III.1 Position Tracking Box Over Target. By manipulating the controls on the OCC, the operator moves the tracking symbol over CRT image of the target to begin tracking.

III.2 Manually Track Until Locked-On. The user follows the target by manually positioning the tracking box over the CRT image until the system locks onto it.

III.3 Initiate Auto-Tracking. Once the system has locked onto the target, the operator initiates auto-tracking by pressing a button on the OCC.

III.4 Generate Audio Cue for Gunner. Gunner is alerted to the presence of a threat by means of an audio notification.

IV. COMPUTE FIRE CONTROL SOLUTION

IV.1 Read Sensors. Tracking information is obtained from sensors in the Electro-Optical Director. Platform information is obtained from ship sensors.

IV.1*a* Obtain Roll & Pitch Angles and Heading. The ship's roll and pitch angles and heading are obtained from external sensors.

IV.1*b* Obtain Azimuth and Elevation Angles. Angles are measured from the T-bar shaft transducers in the pedestal.

IV.1*c* Obtain Target Range. Target range is measured from the laser rangefinder, which if firing at a rate of ten pulses per second. Range data is displayed on the OCC.

IV.2*a* Estimate Ship State. Readings from the ship's motion sensors are filtered to estimate the orientation and velocity of the ship.

IV.2*b* Estimate Target State. The fire control system filters sensor input and estimates target relative position and velocity based on observed range and azimuth and elevation angles.

IV.3 Compute Ballistic Solution. Based on estimated target state, ship state, gun position and observed environmental conditions, a ballistics solution is calculated. The result is a moving-target aimpoint that provides corrections for lead angle and drop. The algorithm used to compute the ballistic solution can be, for instance, the same algorithm used in the Contraves LSEOS Mark II System to compute a ballistical solution or other well known algorithms.

IV.4 Translate to Ship Coordinate Frame. The ballistic solution is converted from an internal reference frame to a ship-based coordinate system.

IV.5 Correct for Parallax. The fire control solution is corrected for the parallax between the EOD sensors and the gun.

IV.6 Generate Aimpoint on Gunner's CRT. Cross-hairs are displayed on the gunner's CRT superimposed on the image of the target. The position of the cross-hairs reflects the relationship between the calculated moving-target aimpoint and the position of the gun.

The entire process of computing a fire control solution is repeated continually, thus presenting an aimpoint to the gunner that is constantly being updated.

V. FIRE WEAPON

V.1 Receive Target Designation. The gunner is notified of target designation by the bridge operator.

V.2 Slew Weapon to Target. The gunner rapidly steers his weapon into the vicinity of the target in order to engage.

V.3 Identify Target. The gunner observes the target on the weapon's integral monitor and makes an identification.

V.4 Manually Steer Weapon. The gunner manually steers the gun to keep the cross-hairs positioned over the target, as displayed on the monitor.

V.5 Receive Authorization to Fire? The gunner receives permission to fire on the target based on the actions of the bridge operator and weapons officers.

V.6 Fire Weapon. The gunner fires the weapon, keeping the cross-hairs positioned over the target, as displayed on the monitor.

A specific operational scenario for the LSEOS MKIII which is a Fire Control System (FCS) for manned un-motorized 20 mm guns is as follows.

The target is detected by surface search radar, Target Designator Sight (TDS) or through the LSEOS MKIII operators console by operator manual operation or automatic search utilizing the monitor at the LSEOS MKIII operators console. The target can be a small patrol craft, helicopter, missile or fixed wing aircraft.

The detection range is a function of the target cross-sectional area (i.e., 3 square meters) for radar detection. In the case of FLIR detection, the thermal characteristics are the determining factor (i.e., 2 degrees C. rise over the background). In the terms of the day video camera, a combination of cross-sectional area and target contrast are the determining factor.

After target detection of up to 20 km, the EOD will be slued to the target bearing and the operator performs a vertical scan either by automatic, semi-automatic or manual means by utilizing the joystick 33. As the vertical scan progresses, the operator observes the monitor 46 and decides upon the classification of the target. When the target comes into range of about 3 to 8 km and the operator recognizes the target as hostile (or conventional image identification software can be used), he manually moves the joystick 33 until the video tracking box is around the targets video image on the monitor and thus the automatic track of the target will have been initiated.

The target is automatically tracked by the video tracker and the laser on the EOD is fired. Based on the return energy and transit time the range to the target is computed. The return range data will be combined with the azimuth and elevation data produced by the azimuth and elevation axis encoders which are on the EOD. The gun position is a known x1, y1, z1 relative to the EOD which is at a position of x2, y2, z2.

This azimuth, elevation and range data is used by the ballistic computer along with EOD and gun position as well as metrological data to compute the future position of the target with respect to the LOS of the gun 12.

The video image of the target is sent to the gunner's video monitor 14. Initially, the gunner probably does not have the target in the field of view in his monitor because there is no reason to assume he is pointing at the target. The monitor 14 has an indicator as to which way the gunner is to move his gun pedestal. As he moves it closer to the LOS of the target, an audible indication occurs as well as visual information on the monitor 14 occurs to indicate when he is getting close to having the gun 12 in line with the target. The closer he gets as he moves the gun axis in azimuth and elevation to align with the target the smaller an azimuth and elevation arrow on the monitor 14 becomes and the lower the sound of the audible alarm.

When the operator has the target lined up with the ballistic computed reticle, the arrows and audible alarm are at zero. The operator can reconfirm the identification of the target and pull the trigger and the gun's projectile will intersect the future position of the target.

Figure 8A:
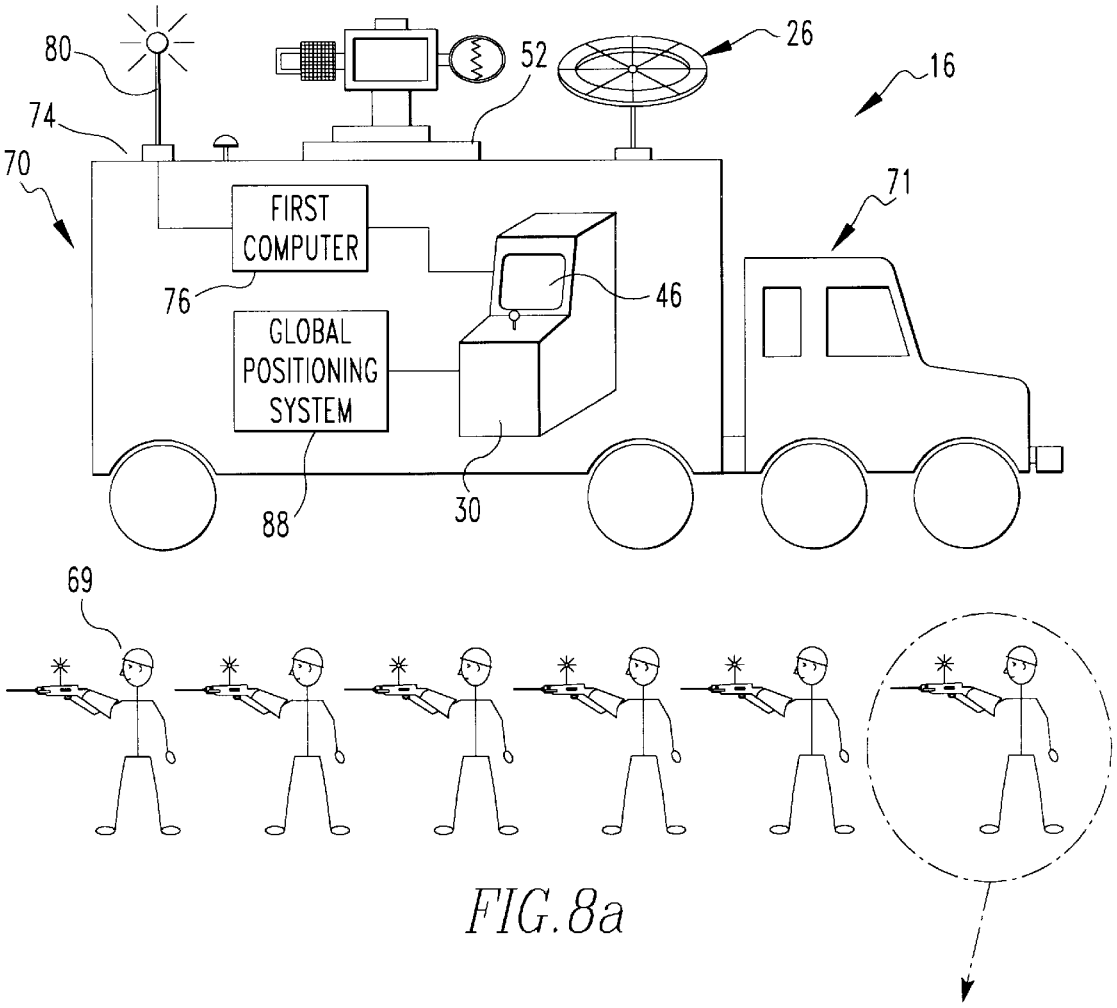
FIGS. 8*a* and 8*b* are schematic representations showing the fire control system being used with a plurality of ground troops.
Figure 8B:
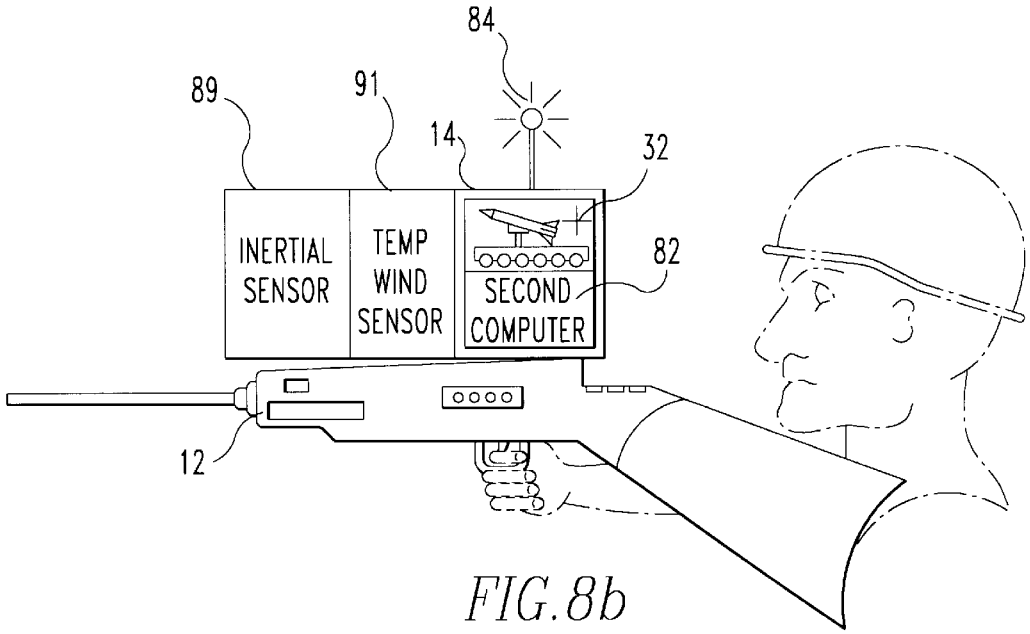

In another embodiment of the invention, the fire control system 10 is used for aiding a plurality of ground troops 69 having manually aimed guns 12, as shown in FIGS. 8*a* and 8*b*, or a plurality of tanks, helicopters or a combination thereof or even of naval vessels. In this embodiment, the means 16 for acquiring a target can be located at a central base station 70. The base station 70 is typically a mobile land vehicle 71 such as an all terrain armored truck or it can be a helicopter or a plane or a satellite.

The base station 70 is used for a visual detection, identification and recognition of a target. The mobile land vehicle 71 can be adapted with an array of sophisticated state-of-the-art target acquiring and imaging devices. The information collected by the these devices can then be transmitted to an area where ground troops 69 are engaged in battle.

Each of the ground troops has a manually aimed gun 12 and sighting device 14 for displaying information transmitted by the base station 70. A second computer 82 on the gun 12 translates the transmitted information with respect to the location and orientation of the respective gun. In this manner, a plurality of troops 69 can be provided with information which can be used for enhanced imaging such as magnified or infrared imaging and/or a dynamic offset computation. The sighting device 14 can be a video display monitor on the gun 12 or goggles such as those by NEC.

Preferably, as previously described, the acquiring means 16 can comprise an electro-optical sensor device having an FLIR imaging device mounted on a pedestal. Preferably, the acquiring means 16 also includes a rangefinder 38. The rangefinder 38 can include a laser rangefinder mounted on the pedestal 29 adjacent to the FLIR imaging device 20 and/or can be comprised of a radar device 26, either active or passive. The pedestal 29 of the electro-optical device 28 is preferably mounted to the roof 74 of the mobile vehicle 71. Preferably, the radar 26 is also located on top of the roof 74 of the mobile vehicle 71 and rotates to scan the area about the mobile vehicle 71.

Within the motor vehicle 71 is a console 30 for controlling movement of the electro-optical device 28. Preferably, there is means 52 for determining the orientation of the acquiring means 16 with respect to a predetermined reference system, such as the earth and a global positioning system (GPS). For instance, as described previously, a gyro reference system can be mounted onto the pedestal 29 to monitor movement of the electro-optical device 28 with respect to the predetermined reference system. As described previously, the console 30 preferably comprises a joystick 33 for controlling movement of the electro-optical device 28 and a control display screen 46 which displays video images from the electro-optical device 28, the radar device 26 and/or the FLIR device 20. The determining means preferably includes a first computer 76 located within the mobile land vehicle 71 and in communication with the various elements of the acquiring means 16. The determining means 16 preferably includes means for transmitting target information. The first computer 76 computes the position of the detected target with respect to the predetermined reference system and provides this information along with any other desired information to a transmitting antenna 80 located on the top 74 of the mobile land vehicle 71. The first computer 76 can have the ability to follow multiple targets at once, as is well known in the art and transmit only target information about a sub-set of all the targets to a given soldier 69, tank or helicopter who are assigned responsibility for that target.

The determining means 16 also comprises a second computer 82 which is located on each gun 12 of the ground troops 69. Each gun 12 is also provided with means for receiving information transmitted by the transmitter 80 at the base station 70, such as a receiving antenna 84. Preferably, each gun 12 is also provided with means for determining the orientation of the gun with respect to a predetermined reference system. The second computer 82 translates the information from the base station 70, which is in terms of absolute coordinates, into the coordinates corresponding to the current location and orientation of the gun 12. In this manner, when each soldier 69 aims his gun 19, the respective sighting device 14 displays information which is proper for the current aim of the gun. For instance, the sighting device 14 can provide a magnified video image of the target or an FLIR image of the target at night for instance.

The second computer 82 can also provide dynamic offset compensations to the sighting device 14. As described previously, dynamic offset compensation is an analytical computation of ballistic and target dynamics, environmental conditions and the geometrical relationship between gun 12 and the target 40. Preferably, the dynamic offset computation is provided to the sighting device 14 in the form of a displaced reticle. In this manner, when the gun 12 is correctly aimed on the image of the target on the sighting device 14, the gun 12 is actually aimed the proper offset amount to accurately hit the target when fired. The means for determining the orientation of the sighting device with respect to a predetermined reference system with a global positioning system 88 or inertial sensor 89 and wind and temperature sensors 91. As is well known, global positioning systems can accurately determine the position of an object on the surface of the earth to within feet.

During the operation of this embodiment plurality of ground troops 69 are equipped with guns 12 each having the sighting device 14 and the communication and computation hardware of the determining means. For sake of illustration, it will be assumed that the target of interest is an enemy scud missile transporter.

The troops 69 and mobile land vehicle 71 are transported to a suitable area. The mobile land vehicle 71 can then use its radar in order to locate the enemy scud missile transporter. To identify, blips detected by the radar 26, the electro-optical device 28 is controlled by an operator of the console 30, to scan the area of interest. The image of the target is shown on the control display screen 46. Its range is determined using the laser rangefinder 38. The location of the acquiring means 16 and mobile vehicle 71 is determined with the global positioning system 88. The position of the target is calculated by the first computer 76 using the determined position of the acquiring means 16, the orientation of the laser rangefinder 38 and the determined target range. Alternatively, the target location can be determined with the coordinates of the radar 26 and the determined position of the acquiring means 16. The determined location of the target is called the target designation site (TDS). It should be appreciated that the present invention is not limited to the cited devices for obtaining a TDS, but envisions that any means capable of obtaining an accurate TDS can be used. The TDS is then transmitted, such as on a military band radiofrequency, along with imaging information of the target, attained by the electro-optical device 28 or the FLIR device 20.

Each of the guns 12 can receive the transmitted information with their own respective receiving antenna 84. The location of each respective gun 12 can be determined with a global positioning system carried by each of the troops. The orientation of the gun 12 is determined with a gyro reference system mounted on the gun and an inertial sensor 89. The second computer 82 figures out what the image should look like on the monitor based on the received TDS and the current orientation and location of the gun 12. In one embodiment, the sighting device 14 can provide a real time image of the target in proper relationship to the aiming line of the gun 12. The image can be magnified or can be an FLIR image. In another embodiment, the sighting device 14 can provide a displaced reticle 32 to compensate for a computed dynamic offset computation computed by the second computer 82.

In this way, one (or more) tracking systems can provide target information to many discrete guns at remote locations and these guns 12 can be accurately aimed and fired.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A fire control system comprising:

a manually aimed gun having a sighting device;

means for acquiring a target, said acquiring means disposed at a location remote from said gun; and means for determining a trajectory of the target with respect to the gun and providing information relating to the target to the sighting device of the gun such that an operator of the gun can aim the gun with respect to the sighting device to hit the target when the gun is fired, said determining means being in communication with said acquiring means and the sighting device.

2. A fire control system as described in claim 1 wherein the acquiring means comprises a radar device.

3. A fire control system as described in claim 2 wherein the acquiring means comprises an electro-optical tracker device having a FLIR imaging device and a laser rangefinder.

4. A fire control system as described in claim 3 wherein the acquiring means comprises a day TV camera device.

5. A fire control system as described in claim 1 wherein the trajectory determining means comprises means for tracking the target.

6. A fire control system as described in claim 5 wherein the determining means comprises means for performing a dynamic offset computation on a target track.

7. A fire control system as described in claim 6 wherein the determining means comprises means for determining a position of the electro-optical tracker device with respect to a predetermined reference system.

8. A fire control system as described in claim 7 wherein the determining means comprises means for determining a position of the gun with respect to a predetermined reference system.

9. A fire control system as described in claim 8 wherein the determining means comprises means for determining a position and movement of a vehicle upon which the fire control system is disposed with respect to a predetermined reference system.

10. A fire control system as described in claim 9 wherein the determining means comprises means for determining environmental conditions about the gun.

11. A fire control system as described in claim 10 wherein the determining means comprises a gun operator data entry device.

12. A fire control system as described in claim 11 wherein the determining means provides a reticle to the sighting device, said determining means displacing said reticle such that when the reticle is manually aimed on the target, the gun is aimed to accurately hit the target when fired.

13. A fire control system as described in claim 12 wherein the determining means provides direction of motion symbology on the sighting device based on the direction and magnitude required to correctly aim the gun.

14. A fire control system as described in claim 13 wherein the determining means provides range data on the sighting device.

15. A fire control system as described in claim 14 wherein the determining means includes a stabilization device for maintaining the aim of the gun.

16. A fire control system as described in claim 15 wherein the sighting device of the gun includes a video display monitor.

17. A fire control system as described in claim 16 wherein the determining means comprises means for providing a FLIR image of the target to the video display monitor of the gun.

18. A fire control system as described in claim 17 wherein the acquiring means comprises a control console having a control video monitor.

19. A fire control system as described in claim 18 wherein the gun comprises a fire enable gate which enables the gun for firing only when the gun is correctly aimed to hit the target, said fire enable gate being in communication with said determining means.

20. A fire control system as described in claim 19 comprising means for providing training images to the video display monitor of the gun such that the fire control system can operate in a training mode.

21. A fire control system as described in claim 20 wherein the determining means comprises a computer.

22. A fire control system as described in claim 21 wherein the manually aimed gun has a caliber between 20 and 40 mm.

23. A fire control method for a minor caliber gun comprising the steps of:

acquiring from a location which is remote from the gun, a trajectory;

determining trajectory of the target with respect to the gun;

providing information relating to the target to a sighting device of the gun; and manually aiming the gun in accordance with information appearing on the sighting device such that the gun is aimed to accurately hit the target when fired.

24. A method as described in claim 23 wherein after the acquiring step, there is a step of tracking the target.

25. A method as described in claim 24 wherein after the tracking step, there is a step of performing a dynamic offset computation on a target track.

26. A method as described in claim 25 wherein the providing step includes a step of providing a displaced reticle on a video display monitor of the sighting device.

27. A method as described in claim 26 wherein the providing step includes a step of providing a FLIR image of the target on the video display monitor.

28. A method as described in claim 27 wherein after the providing step there is a step of enabling the gun when it is aimed in a direction to hit the target.

29. A method as described in claim 28 wherein after the enabling step, there is a step of firing the gun.

30. A method as described in claim 29 wherein the acquiring step includes a step of detecting a target with radar.

31. A fire control system comprising:

a plurality of manually aimed guns each having a sighting device;

means for acquiring at least one target, said acquiring means disposed at a location remote from said guns; and means for determining a trajectory of the target with respect to each gun and providing information relating to the target to the sighting device of each gun such that an operator of each gun can aim the gun with respect to its sighting device to hit the target when the gun is fired, said determining means being in communication with said acquiring means and each sighting device.

32. A fire control system as described in claim 31 wherein the determining means includes sensor means in contact with the gun to sense where the gun will hit when fired.

33. A fire control system as described in claim 32 wherein the determining means includes tracking means in communication with the acquiring means, and a second computer in communication with the gun and the sensor means to provide a reticle to the sighting device such that when the reticle is aligned with the target, the target will be hit when the gun is fired.

34. A fire control system comprising:

a plurality of manually aimed guns each having a sighting device;

means for acquiring a target, said acquiring means disposed at a location remote from that of each gun; and means for providing information relating to the target to the sighting device of each gun, said providing means being in communication with said acquiring means and each sighting device.

* * * * *